US008286364B2

(12) United States Patent
Bae et al.

(10) Patent No.: US 8,286,364 B2
(45) Date of Patent: Oct. 16, 2012

(54) LIQUID STORAGE CONTAINER AND CLOTHES DRYER HAVING THE SAME

(75) Inventors: Sang-Hun Bae, Changwon (KR); Min-Ji Kim, Changwon (KR); Ye-Ji Um, Changwon (KR); Myung-Shik Kim, Changwon (KR); Young-Soo Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 12/585,844

(22) Filed: Sep. 25, 2009

(65) Prior Publication Data

US 2010/0077629 A1 Apr. 1, 2010

Related U.S. Application Data

(60) Provisional application No. 61/100,572, filed on Sep. 26, 2008.

(30) Foreign Application Priority Data

Sep. 26, 2008 (KR) ..... 10-2008-0094958

(51) Int. Cl.
*F26B 19/00* (2006.01)

(52) U.S. Cl. ..... 34/60; 34/88; 34/108; 34/595; 34/606; 68/12.13; 68/18 F; 210/167; 210/263; 134/110; 134/42

(58) Field of Classification Search ..... 34/60, 88, 34/90, 108, 595, 601, 606, 610; 210/167, 210/263; 68/12.3, 18 F; 134/110, 42
See application file for complete search history.

(56) References Cited

U.S. PATENT DOCUMENTS

| | | | | |
|---|---|---|---|---|
| 1,463,342 | A | 7/1923 | Stanley | |
| 4,125,946 | A * | 11/1978 | Prager | 34/80 |
| 5,591,149 | A * | 1/1997 | Cree et al. | 604/378 |
| 5,953,939 | A * | 9/1999 | Guerrero-Parra et al. | 68/23.3 |
| 6,458,257 | B1 * | 10/2002 | Andrews et al. | 204/263 |
| 6,880,192 | B2 * | 4/2005 | Lee et al. | 8/159 |
| 7,024,795 | B2 * | 4/2006 | Tadano et al. | 34/76 |
| 2002/0185423 | A1 * | 12/2002 | Boyd et al. | 210/167 |
| 2006/0169624 | A1 * | 8/2006 | Radomyselski et al. | 210/96.1 |
| 2010/0077629 | A1 * | 4/2010 | Bae et al. | 34/60 |
| 2010/0077631 | A1 * | 4/2010 | Bae et al. | 34/60 |
| 2011/0030150 | A1 * | 2/2011 | Ashrafzadeh et al. | 8/159 |
| 2011/0047811 | A1 * | 3/2011 | Bae et al. | 34/427 |
| 2012/0096737 | A1 * | 4/2012 | Kmet et al. | 34/443 |
| 2012/0144871 | A1 * | 6/2012 | Hardaway | 68/12.02 |

(Continued)

FOREIGN PATENT DOCUMENTS

CN 1614118 A 5/2005

(Continued)

*Primary Examiner* — Stephen M. Gravini
(74) *Attorney, Agent, or Firm* — McKenna Long & Aldridge LLP

(57) ABSTRACT

Disclosed are a liquid storage container and a clothes dryer having the same. The liquid storage container comprises: a reservoir installed at a clothes dryer, and configured to store liquid therein; a floating member floating on the liquid, and disposed on the reservoir with a rotation angle variable according to level change of the liquid inside the reservoir; and display means configured to display information corresponding to the rotation angle of the floating member. The rotation angle of the floating member may vary according to a remaining amount of the liquid. And, the remaining amount of the liquid may be informed to a user through the display means. Accordingly, the user may easily check the remaining amount of the liquid without checking the inside of the liquid storage container.

9 Claims, 3 Drawing Sheets

U.S. PATENT DOCUMENTS

2012/0145196 A1* 6/2012 Hardaway ..... 134/18

FOREIGN PATENT DOCUMENTS

| | | | |
|---|---|---|---|
| DE | 3708516 | A1 * | 9/1988 |
| EP | 0481561 | A2 | 4/1992 |
| EP | 1441058 | | 7/2004 |
| EP | 2145996 | A1 * | 1/2010 |
| JP | 59-028622 | | 2/1984 |
| JP | 2-71796 | | 3/1990 |
| WO | WO 2008/075849 | | 6/2008 |

* cited by examiner

LIQUID STORAGE CONTAINER AND CLOTHES DRYER HAVING THE SAME

RELATED APPLICATION

The present disclosure relates to subject matter contained in priority Korean Application No. 10-2008-0094958, filed on Sep. 26, 2008 and U.S. Patent Application No. 61/100,572, filed on Sep. 26, 2008, which are herein expressly incorporated by reference in its entirety.

BACKGROUND OF THE INVENTION

1. Field of the Invention

The present invention relates to a liquid storage container and a clothes dryer having the same, and particularly, to a liquid storage container capable of storing liquid material such as fragrant material sprayed into a drum of a clothes dryer, and the clothes dryer having the same.

2. Background of the Invention

In general, a clothes dryer indicates an apparatus for drying laundry having completely undergone a dehydration process after a washing process, by introducing the laundry into a drum of the clothes dryer, and by evaporating moisture inside the laundry by supplying hot blast into the drum.

The clothes dryer comprises a drum disposed in the clothes dryer and into which laundry is introduced, a driving motor for driving the drum, a blow fan for blowing air into the drum, and a heating means for heating the air introduced into the drum.

The heating means may use high-temperature electric resistance heat generated by using an electric resistance, or combustion heat generated by combusting gas.

Air having been discharged from the drum contains moisture of the laundry inside the drum, thereby changing into high-temperature humid air. According to a method for processing the high-temperature humid air, the clothes drier may be classified. More concretely, the clothes drier is classified into a condensation type clothes dryer for condensing moisture inside high-temperature humid air by heat-exchanging the high-temperature humid air with external air through circulation in the clothes dryer without discharging the high-temperature humid air out of the clothes dryer, and an exhaustion type clothes dryer for directly discharging high-temperature humid air having passed through the drum to the outside.

When drawing the laundry having completely undergone a washing process out of a washing machine so as to introduce the laundry into the clothes dryer, a user may have discomfort in smelling odor of used washing water and detergent, or odor of the laundry prior to the washing process. Accordingly, it was required to supply fresh feeling of the laundry to the user by removing the odor of the laundry. For this end, there have been efforts to supply functional material such as fragrant material into the drum. The fragrant material to be stored in a storage container has to be supplied with an appropriate amount corresponding to a usage amount. Accordingly, there has been required a means to allow the user to conveniently check a remaining amount of the fragrant material inside the storage container.

SUMMARY OF THE INVENTION

Therefore, an object of the present invention is to provide a liquid storage container capable of storing liquid material therein and easily checking a remaining amount of the liquid material.

Another object of the present invention is to provide a clothes dryer having a liquid storage container capable of easily checking a remaining amount of liquid material.

To achieve these and other advantages and in accordance with the purpose of the present invention, as embodied and broadly described herein, there is provided a liquid storage container, comprising: a reservoir installed at a clothes dryer, and configured to store liquid therein; a floating member floating on the liquid, and disposed on the reservoir with a rotation angle variable according to level change of the liquid inside the reservoir; and display means configured to display information corresponding to the rotation angle of the floating member.

That is, the rotation angle of the floating member floating on the surface of the liquid stored in the reservoir may vary according to level change of the liquid. And, information corresponding to the rotation angle of the floating member is provided to a user through the display means. Accordingly, the user may easily check a remaining amount of the liquid.

The floating member may comprise a coupling portion rotatably fixed to inside of the reservoir, and an arm extending from the coupling portion.

The reservoir may comprise a light transmitting portion, and the coupling portion may be positioned below the light transmitting portion. The light transmitting portion may be implemented as a transparent window formed at a part of the reservoir, or may be implemented by forming the reservoir with a transparent material.

A display portion configured to display a rotated degree of the coupling portion may be formed on an outer circumferential surface of the coupling portion. The display portion may be implemented as calibrations arranged on the outer circumferential surface of the coupling portion. The calibrations may be implemented in the form of bars disposed on the outer circumferential surface with a constant interval therebetween. Alternatively, the calibrations may be implemented as a plurality of regions divided from each other on the outer circumferential surface and displayed in different colors. And, a remaining amount of the liquid corresponding to the rotated degree of the coupling portion may be directly displayed in the form of a numeric value, and a remaining amount of the liquid compared to a storage capacity of the liquid storage container may be displayed.

Among the calibrations, only a calibration corresponding to the remaining amount of the liquid may be displayed through the light transmitting portion. This may allow the user to more easily check the remaining amount of the liquid.

The reservoir may comprise an introduction opening through which liquid is introduced, and the arm may comprise a through hole. Even if the arm is rotated to a maximum degree due to level increase of the liquid, at least a part of the through hole may overlap the introduction opening. The through hole may prevent the arm upwardly moved at the time of liquid injection, from blocking the introduction opening, or prevent the liquid being injected into the introduction opening from being dispersed out with colliding with the arm.

The liquid storage container may further comprise a cover configured to open or close the introduction opening.

The coupling portion may comprise a stopper configured to limit a rotation angle of the floating member. The stopper may prevent a mal-operation of the floating member due to excessive rotation by rotating the floating member within a normal range.

According to another aspect of the present invention, there is provided a liquid storage container, comprising: a reservoir installed at a clothes dryer, and having an introduction opening through which liquid is introduced; a floating member floating on the liquid, rotatably disposed in the reservoir with a rotation angle variable according to a level of the liquid; and display means configured to display information corresponding to the rotation angle of the floating member.

According to still another aspect of the present invention, there is provided a clothes dryer, comprising: a body; a drum rotatably installed in the body; a liquid supplying apparatus configured to supply liquid material into the drum; and a liquid storage container comprising: a reservoir installed at the body, and configured to store liquid therein; a floating member floating on the liquid, and disposed on the reservoir with a rotation angle variable according to level change of the liquid inside the reservoir; and display means configured to display information corresponding to the rotation angle of the floating member.

The liquid storage container may be one of the aforementioned liquid storage containers.

According to yet still another aspect of the present invention, there is provided a clothes dryer, comprising: a body; a drum rotatably installed in the body; a liquid supplying apparatus configured to supply liquid material into the drum; and a liquid storage container comprising: a reservoir installed at the body, and having an introduction opening through which liquid is introduced; a floating member floating on the liquid, rotatably disposed in the reservoir with a rotation angle variable according to a level of the liquid; and display means configured to display information corresponding to the rotation angle of the floating member.

In the present invention, the rotation angle of the floating member may vary according to a remaining amount of the liquid. And, the remaining amount of the liquid may be informed to the user through the display means. Accordingly, the user may easily check the remaining amount of the liquid without checking the inside of the liquid storage container.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a liquid storage container and a clothes dryer having the same according to the present invention will be explained in more detail with reference to the attached drawings.

Figure 1:
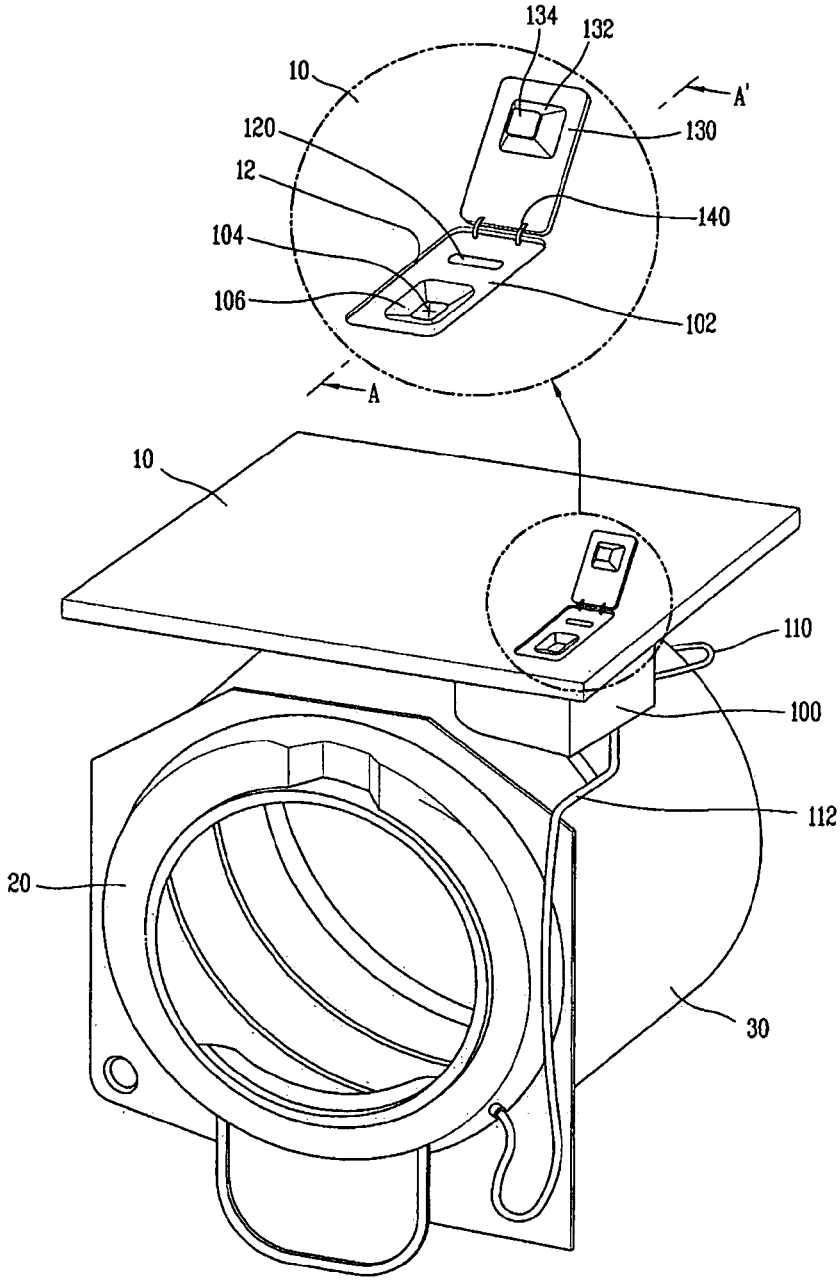
FIG. 1 is a perspective view of a clothes dryer having a liquid storage container according to a first embodiment of the present invention.
Figure 2:
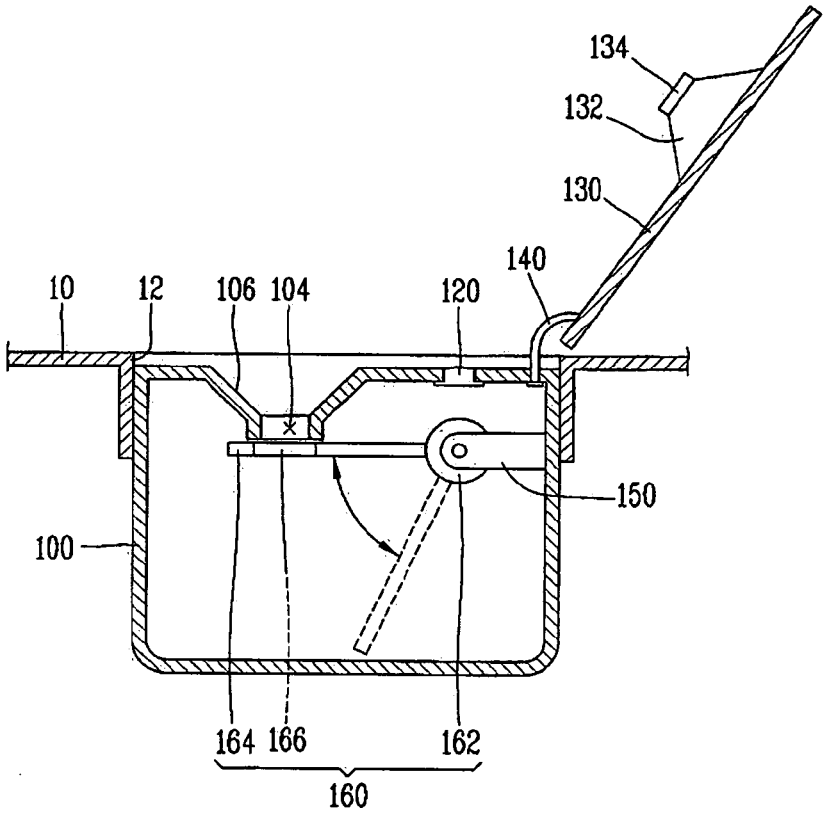
FIG. 2 is a sectional view taken along line 'A-A' in FIG. 1.
Figure 3:
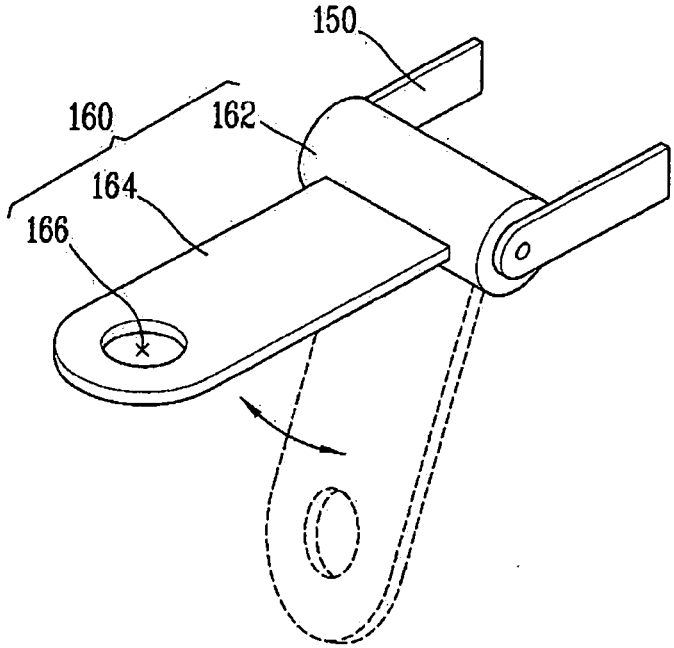
FIG. 3 is an enlarged perspective view of a floating member of FIG. 2.

FIGS. 1 to 3 show an inner structure of a clothes dryer having a liquid storage container according to a first embodiment of the present invention. FIG. 1 shows only an inner structure of the clothes dryer except for an outer panel. In the preferred embodiment of FIGS. 1 to 3, the liquid storage container has been applied to the clothes dryer. However, the liquid storage container may be also is applied to any apparatus for containing specific liquid to be supplemented. For instance, the liquid storage container of FIG. 1. may be also applied to a washing machine having a drying function.

An upper side of the clothes dryer constitutes an upper plate 10. The upper plate 10 forms the appearance of the clothes dryer together with a front plate, side plates, and a rear plate. A front supporter 20 is disposed at a front side of the clothes dryer. The front supporter 20 is disposed on a front surface of a drum 30, and rotatably supports the drum 30 together with a rear supporter (not shown).

A reservoir 100 for storing fragrant material therein is installed on a bottom surface of the upper plate 10. The reservoir 100 may serve to store therein not only fragrant material, but also any liquid material. A fragrant material supplying pipe 110 connected to a nozzle (not shown) through which fragrant material is sprayed into the drum 30 is connected to one side surface of the reservoir 100. And, a fragrant material discharging pipe 112 is connected to a bottom surface of the reservoir 100. The fragrant material discharging pipe 112 serves to discharge fragrant material remaining in the reservoir 100 when other type of fragrant material is to be sprayed into the drum 30.

A cut-out portion 12 is disposed on the upper plate 10 at a position above the reservoir 100. The reservoir 100 is arranged so that an upper surface 102 can be partially exposed out through the cut-out portion 12. An introduction opening 104 is penetratingly formed at the upper surface 102. An orifice portion 106 is concavely formed at the periphery of the introduction opening 104, thereby preventing fragrant material being injected into the introduction opening 104 from flowing to the periphery of the introduction opening 104.

A light transmitting portion 120 is disposed so as to be adjacent to the introduction opening 104, and is fixedly-inserted into a slot formed on the upper surface 102. The light transmitting portion 120 is formed of a transparent or a semi-transparent material so that calibrations that will be later explained can be checked from the outside through the light transmitting portion 120. Alternatively, the light transmitting portion 120 may be implemented by forming only a part of the upper surface 102 of the reservoir 100 with a transparent or a semi-transparent material. The light transmitting portion 120 may be also implemented by cutting a part of the upper surface 102 of the reservoir 100 without implementing an additional member inserted into the upper surface 102.

A cover 130 for covering the cut-out portion 12 is installed at one side of the upper plate 10. The cover 130 is coupled to the upper plate through the cover coupling portion 140, and has a seal 134 at a position corresponding to the introduction opening 104. The seal 134 is attached to a protrusion 132 having a shape corresponding to the orifice portion 106.

Referring to FIGS. 2 and 3, one pair of fixed arms 150 are formed in the reservoir 100, and a floating member 160 is hinge-coupled to the fixed arms 150. The floating member 160 is formed to float on the surface of liquid to be stored in the reservoir 100. And, the floating member 160 includes a coupling portion 162 having a cylindrical shape and hinge-coupled to the fixed arms 150, and an arm 164 extending from the coupling portion 162.

Calibrations are formed on an outer circumferential surface of the coupling portion 162 with a constant interval therebetween. The calibration displays a remaining amount of the liquid stored in the reservoir 100. Alternatively, the outer circumferential surface of the coupling portion 162 may be divided into a plurality of regions having different colors from each other so that the different colors can be seen through the light transmitting portion according to a remaining amount of the liquid.

Under these configurations, a floating height of the end of the arm 164 is varied according to level change of the liquid stored in the reservoir 100, and thereby the coupling portion 162 is rotated. Accordingly, different calibrations are exposed through the light transmitting portion, thereby allowing a user to precisely check the remaining amount of the liquid. Preferably, a width of the light transmitting portion is controlled, thereby exposing only one calibration through the light transmitting portion. In this case, the exposed calibration has to display the current remaining amount of the liquid, through which the user can more rapidly check the remaining amount of the liquid.

A through hole 166 is formed near the end of the arm 164. The through hole 166 is formed at a position overlapping the introduction opening 104 when the arm 164 is upwardly moved to a maximum degree. That is, since the introduction opening 104 is not blocked by the arm 164 even when the arm 164 is upwardly moved to a maximum degree, the liquid being injected into the introduction opening 104 is prevented from being dispersed out with colliding with the arm 164.

A stopper for limiting a rotation angle of the arm 164 may be formed at the fixed arms. That is, two protrusions serving as the stopper may be formed at the fixed arms so that the arm 164 being rotated can be locked by the protrusions. As a result, a rotation angle of the arm 164 may be limited to a predetermined range.

Figure 4:
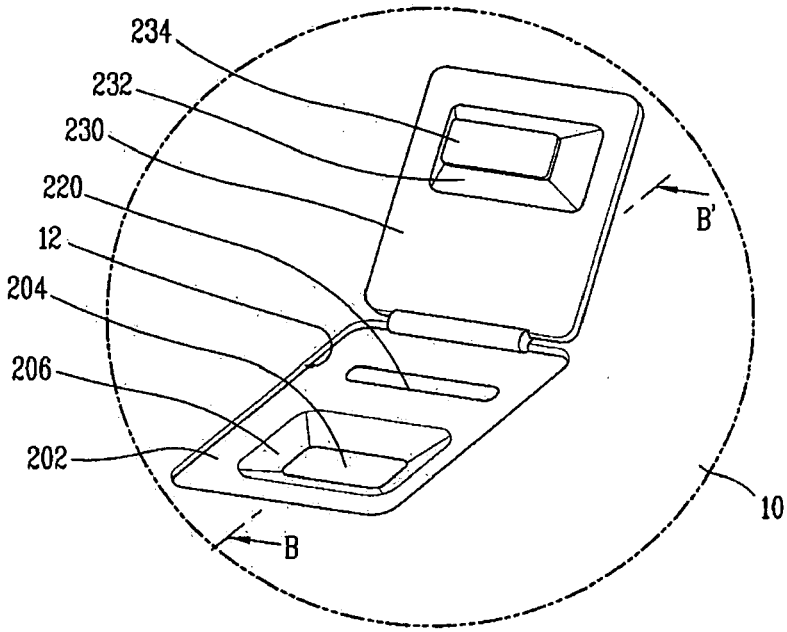
FIG. 4 is a perspective view of a clothes dryer having a liquid storage container according to a second embodiment of the present invention.

FIG. 4 is a perspective view of a clothes dryer having a liquid storage container according to a second embodiment of the present invention. FIG. 4 shows only a part of the upper plate 10 of the clothes dryer for convenience.

A cut-out portion 12 is formed at the upper plate 10, and a reservoir 200 is installed below the upper plate 10 on which the cut-out portion 12 is disposed. The reservoir 200 has an opened upper side, and a cover plate 202 is fitted into the cut-out portion 12. The cover plate 202 includes an introduction opening 204 through which liquid for supplementation is introduced, and an orifice portion 206 formed at the periphery of the introduction opening 204. And, the cover plate 202 also includes a light transmitting slot 220 adjacent to the orifice portion 206 and corresponding to the light transmitting portion 120 of FIG. 1.

A cover 230 is hinge-coupled to the cut-out portion 12. And, a seal 234 is disposed on an inner surface of the cover 230 in correspondence to the introduction opening 204. The seal 234 is attached to a protrusion 232 having a shape corresponding to the orifice portion 206.

Figure 5:
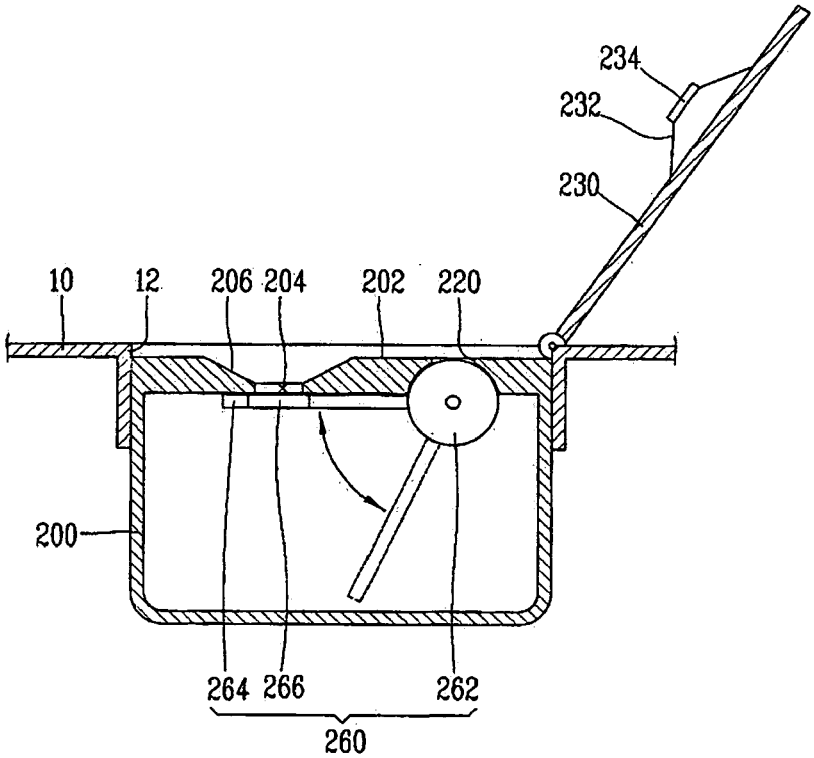
FIG. 5 is a sectional view taken along line 'B-B' in FIG. 4.

Referring to FIG. 5, a floating member 260 is installed in the reservoir 200. And, the floating member 260 includes a coupling portion 262 hinge-coupled to the floating member 260 at a lower side, and an arm 264 extending from the coupling portion 262. An outer circumferential surface of the coupling portion 262 is partially exposed out through the light transmitting slot 220. And, calibrations are formed on the outer circumferential surface of the coupling portion 262 with a constant interval therebetween. The calibrations are exposed out of the cover plate 202 through the light transmitting slot 220, thereby allowing the user to check the remaining amount of the liquid. On the outer circumferential surface of the coupling portion 262, not only the calibrations, but also substantial numeric values or a plurality of regions having different colors may be displayed so as to directly display the remaining amount of the liquid.

A through hole 266 is formed near the end of the arm 264. Like the through hole 166 of FIG. 1, the through hole 266 is formed at a position overlapping the introduction opening 204 when the arm 264 is rotated to a maximum degree. Accordingly, the liquid being injected into the introduction opening 204 is prevented from being dispersed out with colliding with the surface of the arm 264.

In the preferred embodiment, the cover plate 202 and the upper plate 10 are separately formed from each other. However, the cover plate 202 and the upper plate 10 may be integrally formed with each other.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the to foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A liquid storage container, comprising:

a reservoir installed at a clothes dryer, and configured to store liquid therein;

a floating member floating on the liquid, and disposed on the reservoir with a rotation angle variable according to level change of the liquid inside the reservoir; and display means configured to display information corresponding to the rotation angle of the floating member.

2. The liquid storage container of claim 1, wherein the floating member comprises:

a coupling portion rotatably fixed to inside of the reservoir; and an arm extending from the coupling portion.

3. The liquid storage container of claim 2, wherein the reservoir comprise a light transmitting portion, and the coupling portion is positioned below the light transmitting portion.

4. The liquid storage container of claim 3, wherein a display portion configured to display a rotated degree of the coupling portion is formed on an outer circumferential surface of the coupling portion.

5. The liquid storage container of claim 4, wherein the display portion is implemented as calibrations arranged on the outer circumferential surface of the coupling portion.

6. The liquid storage container of claim 5, wherein among the calibrations, only a calibration corresponding to a remaining amount of the liquid is displayed through the light transmitting portion.

7. The liquid storage container of claim 2, wherein the reservoir comprises an introduction opening through which liquid is introduced, and the arm comprises a through hole, and wherein even if the arm is rotated to a maximum degree due to level increase of the liquid, at least a part of the through hole overlaps the introduction opening.

8. The liquid storage container of claim 7, further comprising a cover configured to open or close the introduction opening.

9. The liquid storage container of claim 2, wherein the coupling portion comprises a stopper configured to limit a rotation angle of the floating member.

* * * * *